US006324978B1

(12) United States Patent
Kaulen et al.

(10) Patent No.: US 6,324,978 B1
(45) Date of Patent: Dec. 4, 2001

(54) PRINTING PLATE SUBSTRATE AND METHOD OF MAKING A PRINTING PLATE SUBSTRATE OR AN OFFSET PRINTING PLATE

(75) Inventors: Jürgen Kaulen, Grevenbroich; Wolfgang von Asten, Pulheim; Helmut Schmiedel, Frechen; Barbara Grzemba, Bonn, all of (DE)

(73) Assignee: VAW aluminum AG, Bonn (DE)

( * ) Notice: Subject to any disclaimer, the term of this patent is extended or adjusted under 35 U.S.C. 154(b) by 0 days.

(21) Appl. No.: 09/483,911

(22) Filed: Jan. 18, 2000

(30) Foreign Application Priority Data

Jan. 22, 1999 (DE) ..... 199 02 527

(51) Int. Cl.[7] ..... B41N 1/08; B41N 3/04

(52) U.S. Cl. ..... 101/459; 428/687; 29/895.32; 492/37; 72/199

(58) Field of Search ..... 428/687, 600; 101/459; 72/199; 492/37; 29/895.32

(56) References Cited

U.S. PATENT DOCUMENTS

| | | | | |
|---|---|---|---|---|
| 4,715,903 | * | 12/1987 | Asten et al. | 148/11.5 A |
| 5,998,044 | * | 12/1999 | Limbach et al. | 428/687 |
| 6,024,858 | * | 2/2000 | Nishino et al. | 205/139 |

FOREIGN PATENT DOCUMENTS

| | | |
|---|---|---|
| 484364 | 10/1929 | (DE) . |
| 28 52 002 A1 | 12/1978 | (DE) . |
| 42 11 881 C2 | 4/1992 | (DE) . |
| 43 34 122 C2 | 10/1993 | (DE) . |
| 0573 988 A2 | 6/1993 | (EP) . |
| 0 841 190 A1 | 11/1997 | (EP) . |
| 6-171259 (A) | 9/1994 | (JP) . |
| 6-171261 (A) | 9/1994 | (JP) . |
| 6-262873 (A) | 12/1994 | (JP) . |
| WO 97/31783 | 9/1997 | (WO) . |

OTHER PUBLICATIONS

Japanese Patent Abstract—Publication No. 07205565 A.

* cited by examiner

*Primary Examiner*—John J. Zimmerman
(74) *Attorney, Agent, or Firm*—Darby & Darby

(57) ABSTRACT

The invention relates to a printing plate substrate made of a rolled and embossed aluminum strip, wherein the surface has depressions with an average diameter of <25 $\mu$m and an aspect ratio of <1.5 (ratio length/width relative to the transport direction of the strip). The number of depressions is >2,500/mm$^2$. The invention also relates to a method of making an aluminum printing plate substrate, wherein the surface of the aluminum strip is roughened using rollers. The surfaces of the rollers have microscopically small, stochastically distributed, dome-shaped projections. In cross-sectional view, the rollers have a round ridge-shaped roughness profile. The invention is also directed to an offset printing plate, wherein a printing plate substrate is produced with the method and provided with an anodically deposited oxide layer. A light-sensitive hydrophobic, oleophilic layer is deposited on the oxide layer.

10 Claims, 5 Drawing Sheets

POINTED RIDGE SHAPED PROFILE

ROUND RIDGE-SHAPED PROFILE

PRINTING PLATE SUBSTRATE AND METHOD OF MAKING A PRINTING PLATE SUBSTRATE OR AN OFFSET PRINTING PLATE

BACKGROUND OF THE INVENTION

1. Field of the Invention

The present invention relates to a printing plate substrate made of an aluminum material with a specified surface topography and a method for making the printing plate substrate.

2. Description of the Related Art

Printing plate substrates are typically made of rolled aluminum strips. Substrate materials are pure aluminum (AA1050) as well as alloys of the type AlMn1 and AlMn1Mg (AA3003, AA3103, AA3005). Input stock for producing the strips are rectangular ingots manufactured by a direct chill casing process and having a thickness of up to 600 mm. After the casting skin is milled off, the ingots are rolled into thin strips by hot forming and cold forming; cold forming can be performed either without an intermediate annealing step, or with one or more intermediate annealing steps. The finished rolled strip has a final thickness of 0.1–0.3 mm and a standard so-called mill-finish surface, which is characterized by rolling striations extending parallels to the rolling direction. The striations are produced when the ground steel roller is pressed into the aluminum strip; the steel roller leaves on the strip a roughness Ra=0.1–0.3 $\mu$m in the rolling direction (‖RD) and Ra<0.15 $\mu$m perpendicular to the rolling direction (⊥RD).

The strip is processed into printing plate substrates by roughening the surface of the strip in a subsequent process step. Mechanical, chemical and electrochemical (EC) roughening processes and combinations of such processes are known in the art. The roughened structure is protected (through anodic oxidation) with a thin, hard oxide layer.

An offset printing plate is produced from the printing plate substrate by applying a light-sensitive/photoelectric layer. The surface of the printing plate substrate provides important functions for a.) the adhesion of the photo layer and b.) guiding the water in the subsequent printing process. The printing plates are then exposed, developed and installed on the printing press.

The roughened structure of the printing plate substrate is an important feature of the printing plate, since this structure determines, for example, the lifetime of the printing plate and thus the number of copies that can be printed. Electrochemically roughened plates have optimum properties for printing. Microscopically small indentations are etched in the surface with an acid based either on HCl or $HNO_3$, using alternating current. The roughening step is intended to eliminate the directional mill-finish surface and to produce a fine, nondirectional structure with Ra‖RD=Ra⊥RD in the region of Ra≧0.3–1.5 $\mu$m. The EC process is disadvantageously associated with high processing costs caused by a high power consumption, a need to reprocess the spent chemicals, and disposal of the wastewater and sludge. The conventional processes have so far not been able to achieve a sufficiently fine, nondirectional mechanical roughening. WO 97/31783 (Alcoa) describes a mechanical roughening process using textured rollers Bombardment of the steel roller with a sand-blasting jet, a laser beam, an electron beam or a spark discharge (EDT) creates holes/depressions which have a nondirectional pointed ridge-shaped structure; the roughness of the roller of Ra=0.56–0.76 $\mu$m (22–30 micro-inches) is transferred to the aluminum strip during the last roll-down pass reducing the thickness of the strip; the average roughness of the strip is then approximately Ra=0.33–0.43 $\mu$m (13–17 micro-inches). The Alcoa patent reports a reduction in thickness of 0–15%. This process, which represents a combination of rolling and embossing, produces a flatter and—with higher roll-down ratios—a directional structure on a microscopic scale; the quality of this surface structure for application as printing plates is comparable to that obtained by wet brushing, but is easier and less expensive to produce. However, this process is not suitable for more demanding requirements (i.e., high quality prints): it can not replace the electrochemical roughening process, but may provide a suitable alternative for a mechanical pre-roughening step in a combined mechanical/electrochemical roughening process.

SUMMARY OF THE INVENTION

It is an object of the present invention to provide a purely mechanical roughening process which advantageously combines the cost-effective texturing process using rollers with the superior surface characteristics of EC roughening, so that the resulting structure is at least equivalent to that of an EC-roughened printing plate substrate. The object is solved by the invention through the features recited in the claims.

Printing plate substrates are typically characterized by the average peak-to-valley height Ra (for mechanical tracing according to DIN 4768). The applicant's experiments have shown the unexpected result that the roughness values Ra and Rz do not represent the characteristic parameters which predict the quality of printing plate substrates for finely screened prints. Rather, the dominant characteristic parameter is the micro-roughness, which for high-quality printing plates is characterized by stochastically arranged, tightly packed, trough-shaped depressions having a diameter of <25 $\mu$um. Such a fine structure could until now only be produced by locally dissolving the metal in a chemical/ electrochemical etching step. When this structure is a traced in a linear direction, this structure with the trough-shaped depressions can be referred to as a pointed ridge.

It is possible to emboss the aluminum strip with a roller instead of treating the aluminum strip electrochemically while still attaining the topography of a commercial electrochemically roughened printing plate substrate, if the embossing roller has a profile of a "rounded ridge," since the negative pattern is generally transferred during the rolling process. According to the invention, the surface of the steel rollers used for the embossing are provided with a coating having stochastically distributed, microscopically small, meniscus-shaped projections (spherical calottes), thereby producing the desired pointed ridge-shaped surface structure on the printing plate during the rolling process.

According to the invention, rounded ridge-shaped roller surfaces can be produced by sinter-fusing metal powder or by galvanic precipitation (ECD process), as described, for example, in the patents DE 4211881 and DE 4334112. Preferably, the rollers are coated to produce calottes with an average diameter of ≦20 $\mu$m with a density of at least 3000/mm$^2$, i.e., the calottes are tightly packed. The frequency distribution curve of the diameters of the calottes should correspond to a normal distribution. The roughness values of the coated roller are Ra≦1.5 $\mu$m and Rz≦8 $\mu$m, as measured with a mechanical sensing unit having a contact stylus instrument and an electrical wave filter.

It has been observed that when a roller which is coated in this manner is used for embossing, the thickness should be consistently reduced by at least 0.2% in order to transfer the trough-shaped structure to the strip. However, the thickness should not be reduced by more than 5% since the strain caused by a larger deformation may smear the structure.

The printing plate substrates which are embossed with this type of roller, show macroscopically a uniform satin-finish appearance. A scanning electron microscope (SEM) image shows a nondirectional structure with depressions having an average size of ≦25 μm and a ratio of the length of the depression (‖RD) to the widths of the depression (⊥RD) of ≦1.5 (when referring to aspect ration, the ration of length/width relative to the transport direction of the strip is meant). The depressions abut each other, but are not connected with each other, so that a pointed ridge-shaped structure is produced. The average peak-to-valley height is in the range Ra=0.5–1.5 μm; the values measured in the longitudinal direction are only slightly different from those measured in the transverse direction (Ra‖RD≈Ra⊥RD; difference ≦15%).

Since the typical roughness values Ra and Rz do not adequately describe the characteristic structural features of the printing plate substrate, it would be desirable to find a characteristic parameter which correlates with the qualitative features of the printing process. It has been observed that such a parameter indicative of the quality can be the number of depressions, if that number is taken to be equal to the normalized peak count Pc (a parameter from the conventional roughness measurement with mechanical tracing according to DIN 4768: number of counted "peaks" along a specified reference path) having counting threshold values of between −0.75 and −0.50 μm (below the center line of the roughness profile). According to the invention, the limit values for a counting threshold of −0.75 μm should always be Pc>100/cm and, more particularly, the limit values for a counting threshold of −0.5 μm should always be Pc>150/cm. With these values of Pc, the fine structure of the printing plate substrates indicative of the quality of the printing process can be compared by performing conventional roughness measurements; this aspect will be illustrated hereinafter by comparing printing plate substrates prepared according to the invention with EC-roughened structures found on commercially available plates (which the invention attempts to match) and an embossed surface according to the present state-of-the-art (Alcoa patent).

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views:

FIG. 2 is an SEM photograph of the surface structure of a product according to an embodiment 1a;

FIG. 4 is an SEM photograph of an EC-roughened plate according to a comparison example 2a;

DETAILED DESCRIPTION OF THE PRESENTLY PREFERRED EMBODIMENTS

Figure 1A:
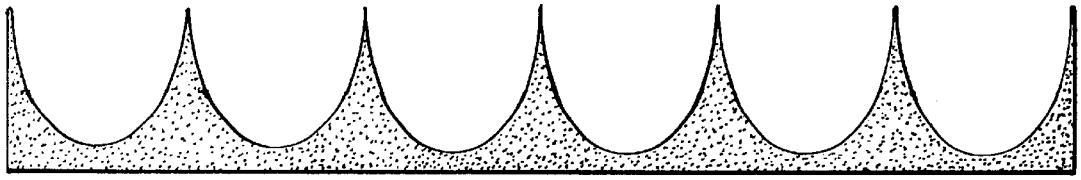
FIG. 1 is a cross-section through a pointed ridge-shaped profile (a) and a rounded ridge-shaped profile (b)

All of the following examples are based on the same base material, namely an A199.5 strip which is manufactured by a conventional process from an ingot by hot and cold rolling with intermediate annealing steps. The strips are roughened by different processes:

- printing plate substrate produced according to the invention with a pointed ridge-shaped roller;
- printing plate substrate produced by the electrochemical roughening;
- a printing plate substrate produced with textured rollers.

The surface topography is investigated by two different experimental methods which are commonly used to characterize printing plate substrates and to which each manufacturer of such plates has access:

- a roughness measurement by mechanically tracing the surface with a contact stylus instrument, with the roughness of the surface characterized by the following three parameters:
  - $R_a$ (arithmetic peak-to-valley height; in England previously referred to as CLA=center line average, in the USA referred to as AA=arithmetic average);
  - $R_z$ (averaged peak-to-valley height);
  - $P_c$ (normalized number of peaks; this parameter measures the number of peaks along a specified reference path (per cm) for a specified counting threshold (listed after the
  - $P_c$-value, for example −0.5 μm); and
- an image of the topography obtained with a scanning electron microscope (SEM).

Embodiments 1a, b of the Invention

Printing Plate Substrate with an Embossed Surface

The starting material for the printing plate substrate was a rolled strip of pure aluminum (AA1050) with a thickness of 0.3 mm and a mill-finish surface.

The roller used to emboss the strip was electroplated. The object to be coated forms the cathode. The anode and the cathode are connected to a regulated source of electric energy. The surfaces of the anode and the cathode forming the object to be coated are spaced apart in a liquid electrolyte. The electric energy source is controlled by a programmable controller. Any desired time-dependent voltage and current curve can be set with the controller, wherein the current/voltage is then automatically supplied by the energy source to the electrodes. A galvanic bath consists of a sulfuric chromium electrolyte with 200 grams chromic acid $CrO_3$ and 2 grams sulfuric acid $H_2SO_4$. In order to provide a starting surface suitable for forming the chrome-plated structure, the cylinder formed of St52 is initially finely ground. with a peak-to-valley height of Rz <3 μm. A nickel layer having a thickness of 30 μm is subsequently applied under conditions commonly used in the galvanic industry, followed by the application of a tear-resistant chromium layer having a thickness of 10 μm The workpiece prepared in this manner is rotated in the galvanic bath to apply a very uniform coating of a structural chromium layer. The workpiece forms the cathode, whereas the anode is formed of platinum-coated titanium or PbSn7. The spacing between the anode and the cathode is adjusted to 25 cm. At this point, the actual structure is produced. During the two phases, the current density is increased stepwise, until it reaches the structural current density. The characteristic parameters of the steps (the height of the current steps and the time interval between two current steps) are varied when the current density is increased. During the first phase, the current is increased in 16 steps to 40 mA/cm$^2$, which corresponds to a change in current density at each step of 2.5 mA/cm$^2$. The time interval between two current steps is 5 seconds. Thereafter, during the second phase, the current density is increased in 62 additional steps to the structural current density of 100 mA/cm$^2$, with the time interval between two current steps being 6 seconds. Once the structural current density is reached, this current density is kept constant during the ramp-up time. The DC current flowing through the electrolyte leads to a growth of the structural layer produced during the two phases. The duration of the ramp-up time is 60 seconds. The current density is then decreased stepwise in 22 steps to a final value of 0 mA/cm$^2$. The time interval between two current steps in this case is 4 seconds. The surface of the coated roller had a roughness of Ra=1.26 $\mu$m and Rz=7.1 $\mu$m. The roller surface has microscopically small, round, meniscus-shaped projections (spherical calottes) with an average diameter of 16 $\mu$m. The size of the calottes is distributed according to a normal distribution. The number of calottes was determined to be 5000/mm$^2$. The resulting surface roughness profile, as viewed in cross-section, can be characterized as having a rounded ridge-shaped structure.

When the aluminum strip is embossed, the structure is transferred to the surface of the strip. In the aforedescribed examples, the strip was embossed with the following roll-down values using the roller described above: in the example 1a, the thickness is reduced by 1.5%, in the example 1b, the thickness is reduced by 4%.

Figure 2:
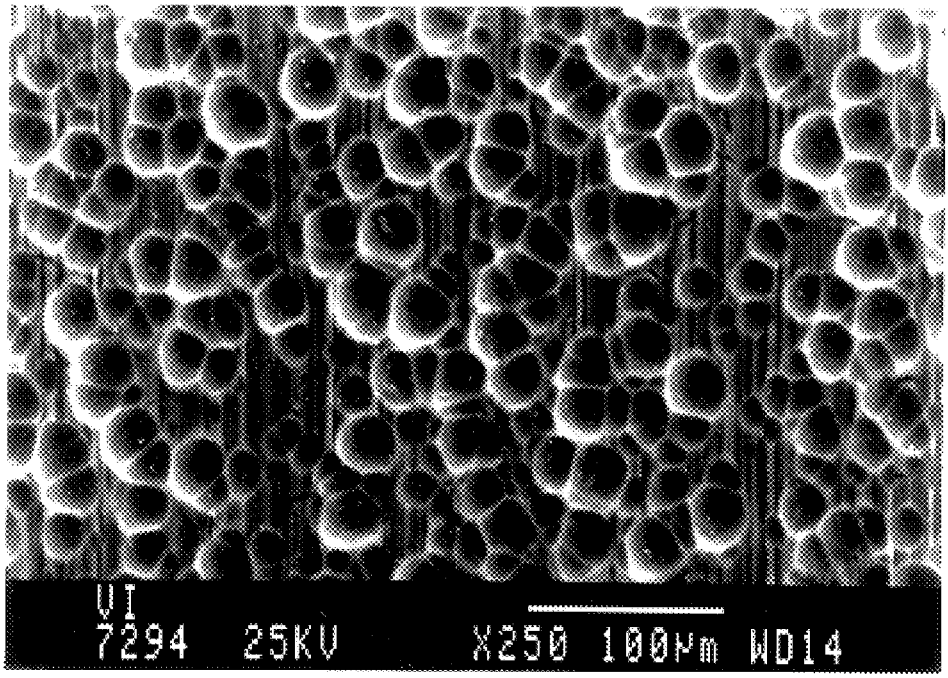

The embossed strips show macroscopically a satin-finish appearance. A scanning electron microscope image of the microscopic structure is reproduced in FIGS. 2 and 3. As seen in the FIGS. 2 and 3, closely spaced round depressions are formed. These depressions, however, are not connected with each other. The depressions produced with the two different roll-down values had an average size of 22 $\mu$m and a density of approximately 2800/mm$^2$. The aspect ratio of the depressions and the area coverage can be varied by changing the degree of the roll-down:

for a roll-down of 1.5% (comparison example 1a), an area coverage of 80% is attained at an aspect ratio of the depressions of 1.1;

for a roll-down of 4% (comparison example 1b), the area coverage is almost 100%, with the depressions elongated by $\leqq$1.5%.

In both cases, the roughness profile of the strips in cross-section resembles that of a pointed ridge.

The measured roughness parameters Ra and Rz for the comparison examples 1a and 1b are listed in Table 1. The structures are nondirectional—as required for a printing plate substrate: the values for Ra parallel and transverse to the rolling direction differ by less than 10%. The values for Pc determined by a roughness measurement (normalized number of peaks) are:

| | |
|---|---|
| for the roll-down degree of 1.5% | (comparison example 1a) |
| Pc = 172/cm (−0.5 $\mu$m) | and Pc = 153/cm (−0.75 $\mu$m) and |
| for the roll-down degree of 4% | (comparison example 1b) |
| Pc = 184/cm (−0.5 $\mu$m) | and Pc = 162/cm (−0.75 $\mu$m). |

Figure 7:
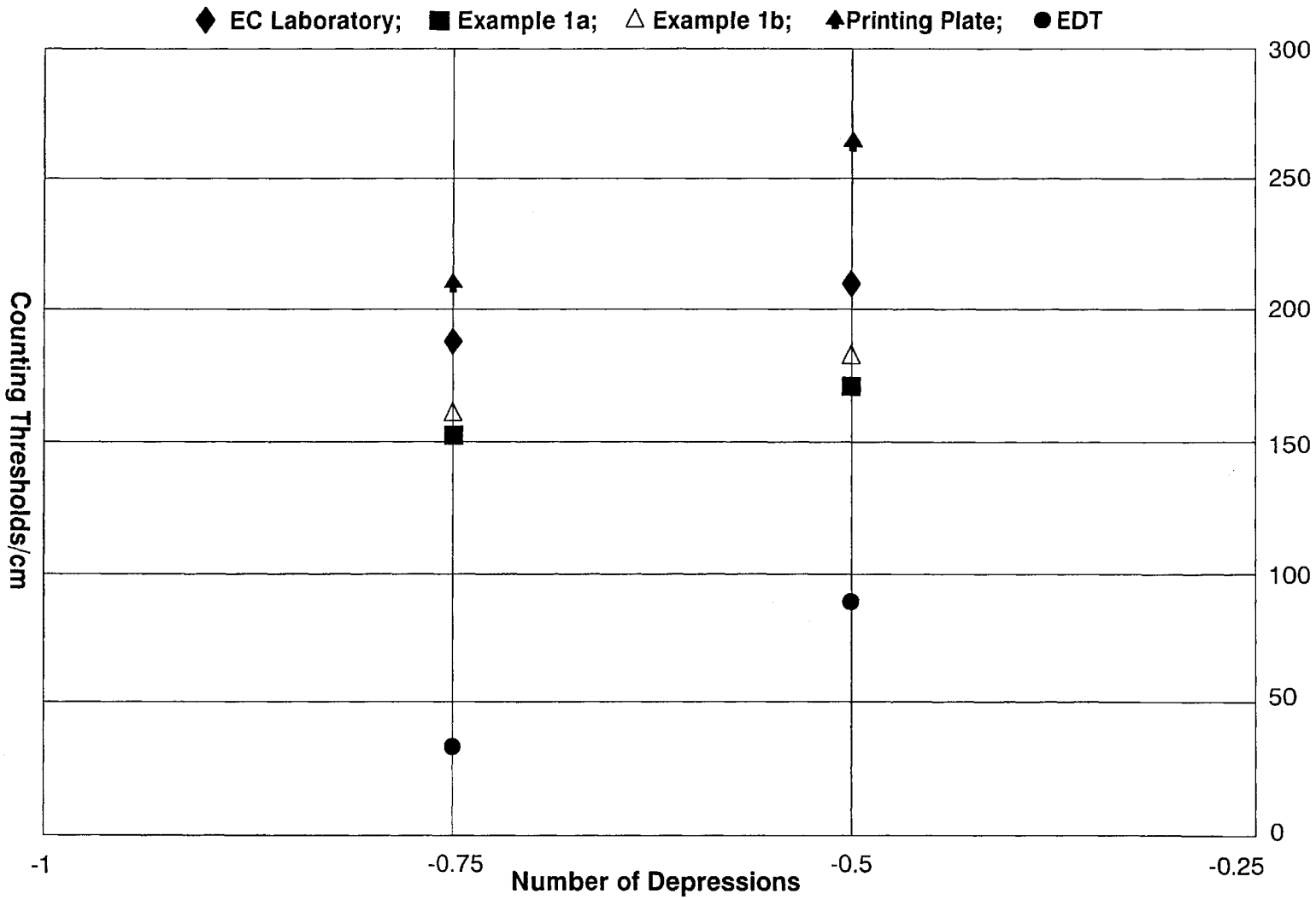
FIG. 7 shows a diagram with the normalized peak count Pc of the examples 1 to 3, illustrated for the counting thresholds of −0.75 to −0.5.

Remarkably, the Pc values are similar to those of EC-roughened plates, see also comparison examples 2a, b and FIG. 7.

The characteristic features of the surfaces embossed according to the invention are listed in Table 1.

COMPARISON EXAMPLES 2A, B

Electrochemically Roughened Printing Plate Substrates

Two electro-chemically roughened printing plate substrates with significantly different Ra values were selected as comparison examples.

The printing plate substrate in the comparison example 2a was taken from a sample roughened in a laboratory using the parameters listed in Table 2; the printing plate substrate has a roughness of Ra=1.1/1.01 $\mu$m||/⊥RD (the light-sensitive layer was removed).

Figure 4:
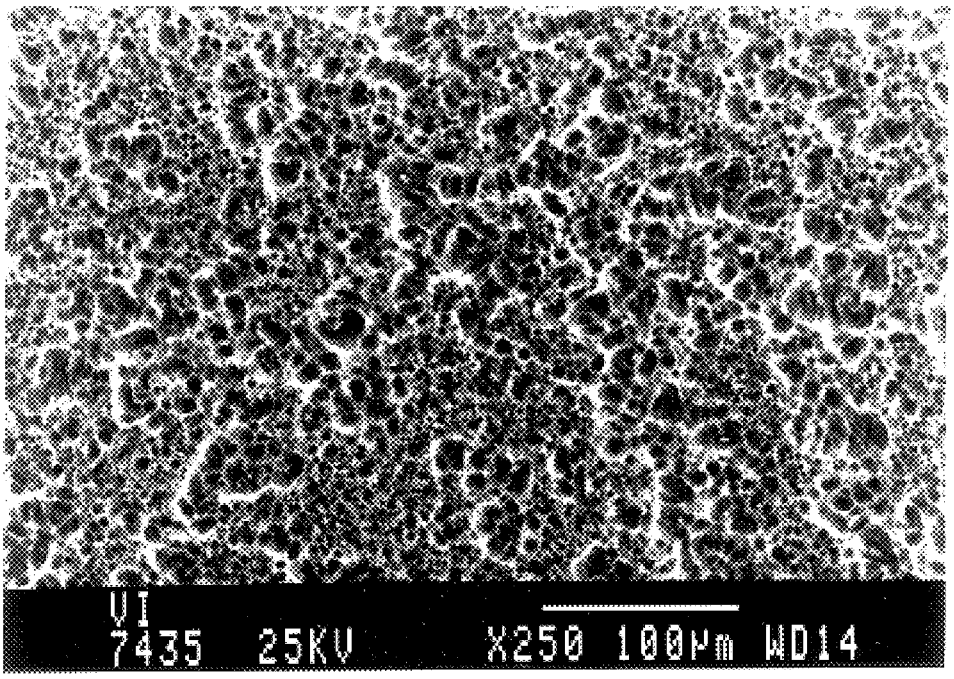
Figure 5:
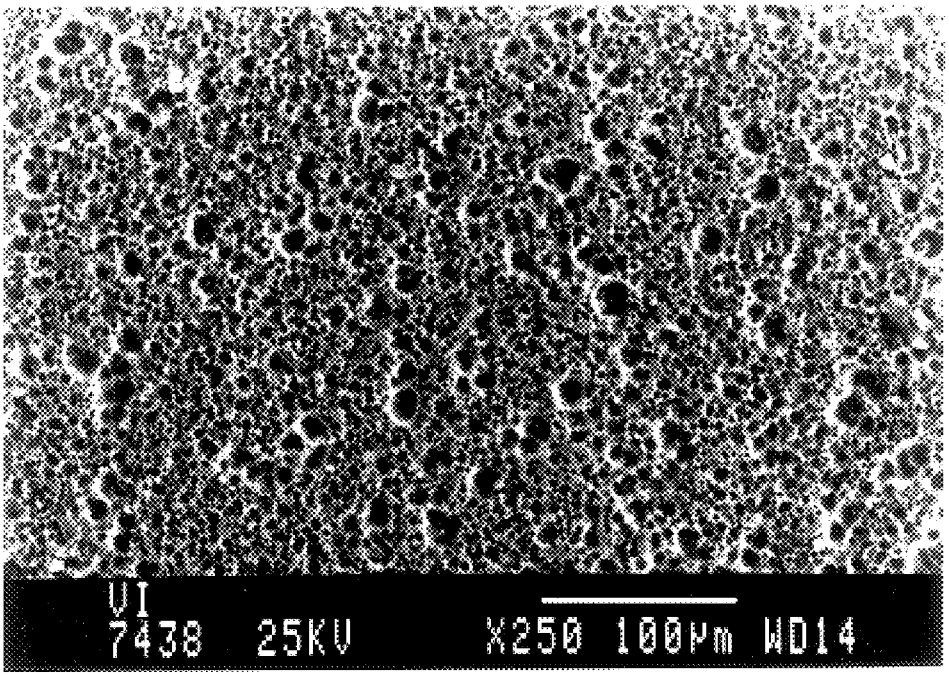
FIG. 5 is an SEM photograph of an EC-roughened plate according to a comparison example 2b.

Scanning electron microscope (SEM) images of the surface shows a rough pointed ridge-shaped structure which is typical for EC-roughened plates and consists of coarse, fine and superfine depressions arranged side-by-side, as illustrated in FIGS. 4, 5.

The additional surface roughness parameters are listed in Table 2. Surprisingly, the rough surfaces which have significantly different Ra values, have a common feature: the Pc values for a counting threshold of −0.75 $\mu$m are in the range of >100/cm and for a counting threshold of −0.5 $\mu$m in the range of >150/cm; the counting thresholds which are below the center line of the surface roughness profile, apparently measure the coarse depressions disposed in the printing plate substrate.

COMPARISON EXAMPLE 3

Printing Plate Substrates with an Embossed Surface According to the Alcoa Patent The starting material for the printing plate substrate was the same rolled pure aluminum strip (AA1050) with a thickness of the 0.3 mm and a mill-finish surface that was used for the printing plate substrate of the invention. The strip was embossed according to the method disclosed in WO 97/31783 using a roller which was roughened by electron discharge texturing (EDT). The EDT-textured roller has a roughness of Ra=1.3 $\mu$m and Rz=7.3 $\mu$m which is similar to that of the coated roller used with the invention. Unlike the roughness profile of the coated roller, the roughness profile of the EDT roller in cross-section can be characterized as a pointed ridge.

The structure is transferred to the surface of the strip when the aluminum strip is embossed. In the illustrated example, the thickness of the strip (according to the example 1b of the invention) was reduced in the rolling process by 4%; a roll-down of >5% results in an unwanted directional structure.

Figure 6:
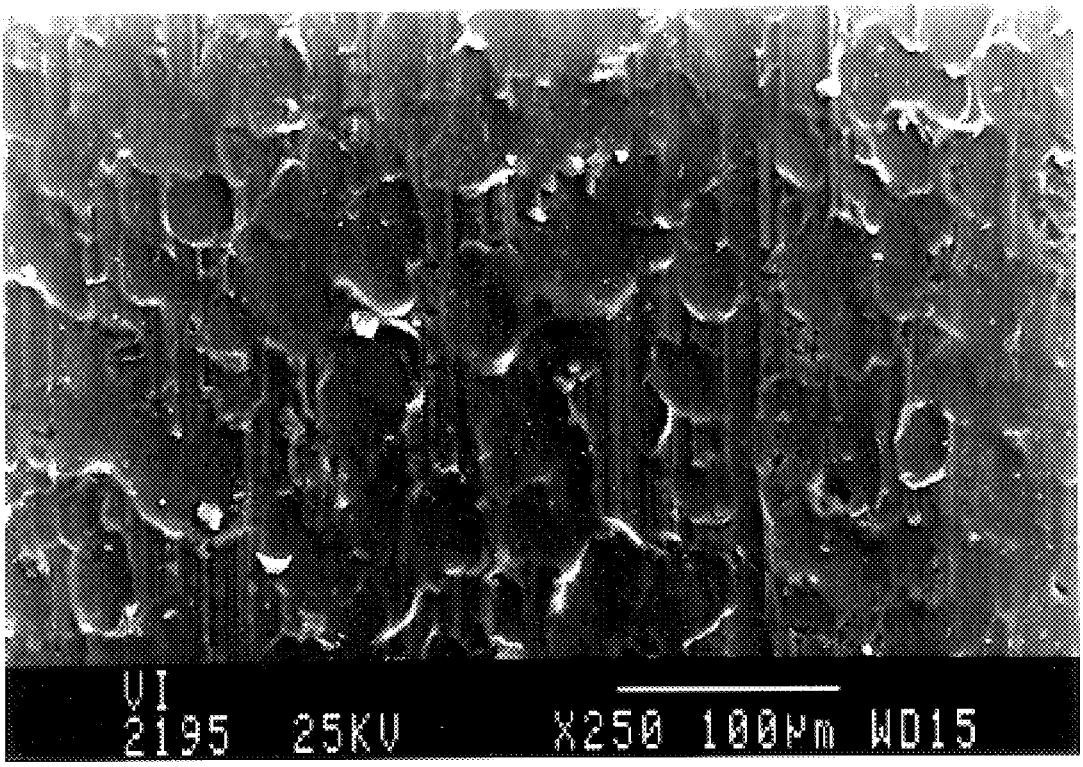
Fig. 6 Prior Art
FIG. 6 is an SEM photograph of a surface topography which is produced according to a comparison example 3.

The surface topography produced during embossing was investigated under a scanning electron microscope and is illustrated in FIG. 6. No characteristic structure with depressions is observed.

A measurement of the surface roughness with a mechanical stylus produced values of Ra=0.42/0.41 $\mu$m y/⊥RD and Rz=3.12 $\mu$m for the comparison example, as listed in Table 3. The significant difference to the surface of the invention is evident from the Pc values (normalized peak count): the following values are determined by a mechanical roughness measurement Pc=89/cm (−0.5 $\mu$m) and Pc=34/cm (−0.75 $\mu$m).

Referring now to FIG. 7, the values Pc/cm for the counting thresholds −0.5 $\mu$m and −0.75 $\mu$m are plotted in the same graph for all the examples 1a, 1b, 2a, 2b, 3. It is evident that the surfaces of the invention have characteristic values in the same range as the EC-roughened plates. The surface embossed with an EDT-textured roller, on the other hand, falls way outside this range. When the surfaces are embossed with a roller having a rounded ridge-shaped profile, a surface roughness profile is produced which is similar to that produced by EC-roughening; however, this is not the case when a EDT roller with a pointed ridge-shaped surface structure is used.

The present invention provides a mechanical roughening process for producing printing plate substrates which combines the advantages of low production cost, as a result of texturing with a roller, with the surface properties of EC roughening; the resulting structure is equivalent—as measured by the Pc values—to an EC-roughened printing plate substrate.

An offset printing plate can be produced from the printing plate substrate of the invention by subsequently applying an anodic oxide layer, followed by a light-sensitive layer. The rough surface structure provides particularly good adhesion of the photosensitive layer and also has excellent water-guiding properties in the printing process.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

TABLE 1

Figure 1B:
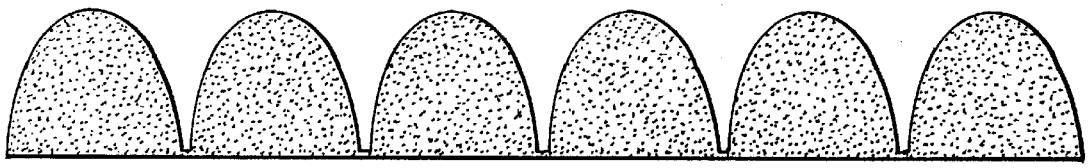

| Example according to the invention 1a<br>Surface according to the invention | Example according to the invention 1b<br>Surface according to the invention |
|---|---|
| Roughening method:<br>Embossing with a Cr-coated roller:<br>Ra = 1.26 μm<br>Rz = 7.1 μm<br>Profile: pointed ridge;<br>Spherical calottes of the layer:<br>Avg. ø 16.1 μm<br>Min. ø 5 μm<br>Max. ø 25 μm<br>Frequency distribution<br>→Normal distribution<br>→Standard deviation 8 μm<br>Count: 5000/mm$^2$ | Roughening method:<br>same as Example 1a |
| Experimental rolling<br>Roll-down degree: 1.5%<br>SEM<br>Avg. trough ø 22 μm<br>(min-max: 8–37 μm)<br># of troughs/mm$^2$: ca. 2800<br>Elongation of the troughs: 1.1<br>Area coverage: 80%<br>FIG. 1a | Experimental rolling<br>Roll-down degree: 4%<br>SEM<br>Avg. trough ø 22 μm<br>(min-max: 8–37 μm)<br># of troughs/mm$^2$: ca. 2800<br>Elongation of the troughs: 1.5<br>Area coverage: 97%<br>FIG. 1b |
| Roughness measurement:<br>Ra = 1.02 μm ∥ RD<br>Ra = 0.93 μm ⊥ RD<br>Rz = 5.36 μm<br>Pc = 172/cm (−0.5 μm)<br>Pc = 153/cm (−0.75 μm) | Roughness measurement:<br>Ra = 1.15 μm ∥ RD<br>Ra = 1.12 μm ⊥ RD<br>Rz = 6.20 μm<br>Pc = 184/cm (−0.5 μm)<br>Pc = 162/cm (−0.75 μm) |

TABLE 2

| Comparison example 2a<br>EC-roughened surface | Comparison example 2b<br>EC-roughened surface |
|---|---|
| Roughening method:<br>HCl roughening coarse<br>Laboratory roughening:<br>● NaOH pickle | Roughening method:<br>HCl roughening medium<br>Commercially available printing plate;<br>For testing, the photosensitive layer was removed |
| ● Roughening parameter:<br>50 Hz AC<br>15 A d/dm$^2$<br>2000 C/dm$^2$<br>7 g/l HCl<br>1 g/l $Al^{3+}$<br>25° C.<br>● Grit removal<br>$H_3PO_4$<br>● Anodic anodizing | |
| SEM<br>FIG. 2a | SEM<br>FIG. 2b |
| Roughness measurement:<br>Ra = 1.11 μm ∥ RD<br>Ra = 1.01 μm ⊥ RD<br>Rz = 6.63 μm<br>Pc = 210/cm (−0.5 μm)<br>Pc = 189/cm (−0.75 μm) | Roughness measurement:<br>Ra = 0.62 μm ∥ RD<br>Ra = 0.69 μm ⊥ RD<br>Rz = 5.75 μm<br>Pc = 263/cm (−0.5 μm)<br>Pc = 206/cm (−0.75 μm) |

TABLE 3

Figure 3:
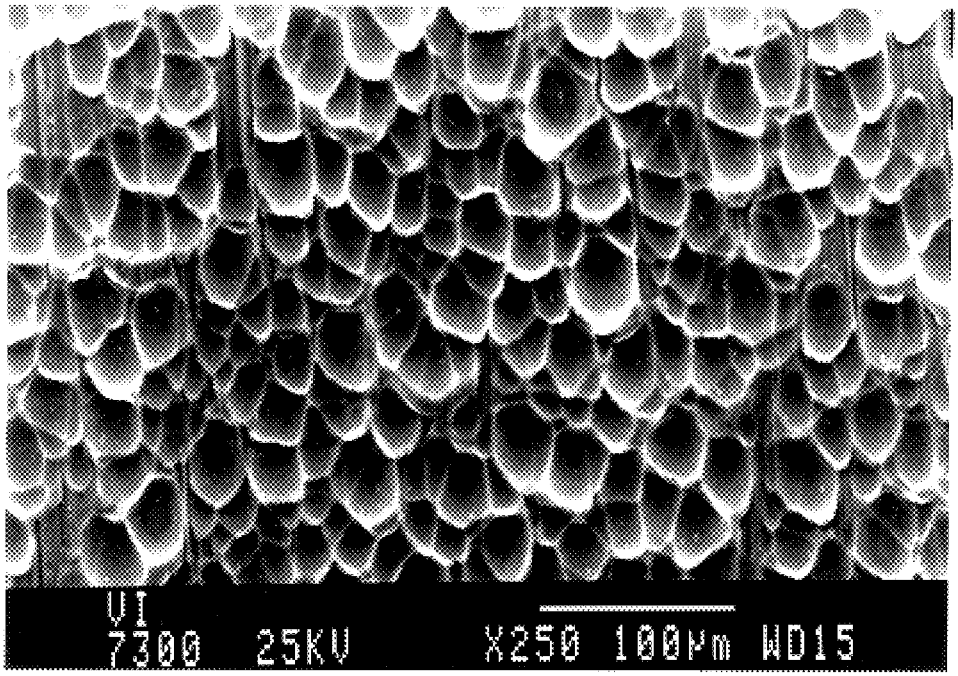
FIG. 3 is an SEM photograph of the surface structure of a product according to an embodiment 1b.

| Comparison example 3 |
|---|
| Experimental rolling according to the Alcoa patent Roughening method:<br>Embossing with a textured roller/EDT:<br>Ra = 1.3 μm<br>Rz = 7.3 μm<br>Profile: pointed ridge<br>Roll-down degree 4% SEM<br>SEM<br>FIG. 3<br>Roughness measurement:<br>Ra = 0.42 μm ∥ RD<br>Ra = 0.41 μm ⊥ RD<br>Rz = 3.12 μm<br>Pc = 89/cm (−0.5 μm)<br>Pc = 34/cm (−0.75 μm) |

What is claimed is:

1. A printing plate substrate comprising a rolled and embossed aluminum strip, the rolled and embossed aluminum strip includes a surface having depressions with an average diameter smaller than 25 μm, an aspect radio of ≦1.5 (ratio length/width with regard to the transport direction) and more than 2,500/mm$^2$ numbers of depressions.

2. The printing plate substrate according to claim 1, wherein the distribution of the diameter of the depressions has a standard deviation of <10 μm.

3. The printing plate substrate according to claim 2, wherein the surface has a nondirectional surface structure with trough-shaped depressions and a normalized peak count of Pc>100/cm for a counting threshold of −0.75 μm below a center line of the surface roughness profile, as measured by mechanically scanning with a contact stylus instrument.

4. The printing plate substrate according to claim 3, wherein the surface structure includes by a normalized peak count Pc>150/cm for a counting threshold of −0.5 μm below the center line of the surface roughness profile, as measured by mechanically scanning with a contact stylus instrument.

5. A method of manufacturing an aluminum printing plate substrate comprising the steps of producing a rectangular ingot in a direct chill casting process;

milling off the casting skin;

rolling the ingot into a thin aluminum strip having a surface by hot forming and cold forming;

mechanically roughening the surface with embossing rollers having round ridge-shaped roughness surface profiles, having microscopically small, stochastically distributed, dome-shaped projections and creating a nondirectionally roughened aluminum strip surface resulting in depressions with an average diameter smaller than 25 $\mu$m, an aspect ratio of $\leqq 1.5$ with regard to the transport direction of the strip and more than $2.500/mm^2$ numbers of depressions.

6. The method according to claim 5, wherein the surfaces of the embossing rollers are structured by galvanic precipitation in an electrolyte, with an electric current and voltage, respectively, supplied in the form of pulses.

7. The method according to claim 6, wherein the galvanic coating of the rollers is provided by a DC current deposition process with initial pulses for nucleation of the precipitate and subsequent pulses.

8. The method according to claim 7, wherein the rollers have a roughness of $Ra \leqq 1.5$ $\mu$m and $Rz \leqq 8$ $\mu$m, as measured with a mechanical sensing unit having a contact stylus instrument and an electrical wave filter.

9. The method according to claim 5, wherein the embossing process is associated with a reduction in thickness of 0.2–5%.

10. An offset printing plate, manufactured according to claim 5 and made of a printing plate substrate according to claim 1, wherein the printing plate substrate includes an anodically deposited oxide layer, and wherein a light-sensitive hydrophobic, oleophilic layer is deposited on the oxide layer.

* * * * *